US012180877B1

(12) United States Patent
Ruehl et al.

(10) Patent No.: US 12,180,877 B1
(45) Date of Patent: Dec. 31, 2024

(54) METHOD FOR ABSORBING HYDROGEN IN A CRANKCASE OF A HYDROGEN INTERNAL COMBUSTION ENGINE, A SYSTEM FOR A MOTOR VEHICLE, AND A MOTOR VEHICLE

(71) Applicants: HYUNDAI MOTOR COMPANY, Seoul (KR); KIA CORPORATION, Seoul (KR)

(72) Inventors: Timo Ruehl, Mettenheim (DE); Ulrich Karrer, Mainz (DE); Lutz Cardel, Idstein (DE); Andrea Valentini, Casalgrande (IT); Oliver Burghardt, Muhltal (DE); Andreas Kapp, Eschborn (DE)

(73) Assignees: HYUNDAI MOTOR COMPANY, Seoul (KR); KIA CORPORATION, Seoul (KR)

( * ) Notice: Subject to any disclaimer, the term of this patent is extended or adjusted under 35 U.S.C. 154(b) by 0 days.

(21) Appl. No.: 18/610,258

(22) Filed: Mar. 19, 2024

(30) Foreign Application Priority Data

Oct. 19, 2023 (DE) ..... 102023128700.1

(51) Int. Cl.
*F02B 43/10* (2006.01)
*F01M 11/02* (2006.01)
*F01P 3/10* (2006.01)

(52) U.S. Cl.
CPC ..... *F01P 3/10* (2013.01); *F01M 11/02* (2013.01)

(58) Field of Classification Search
CPC ..... F02M 21/0206; F02M 21/0227; F02M 27/02; F02M 21/02; F02M 26/13;
(Continued)

(56) References Cited

U.S. PATENT DOCUMENTS 10,309,290 B2 6/2019 Yamashita

FOREIGN PATENT DOCUMENTS

CN 108547710 B * 9/2020 ..... F01N 5/02
CN 115111089 A * 9/2022 ..... C01B 3/047
(Continued)

*Primary Examiner* — George C Jin
*Assistant Examiner* — Teuta B Holbrook
(74) *Attorney, Agent, or Firm* — MCDONNELL BOEHNEN HULBERT & BERGHOFF LLP

(57) ABSTRACT

A method for absorbing hydrogen in a crankcase of a hydrogen internal combustion engine is provided, comprising injecting, by a hydrogen injector, hydrogen into a combustion chamber of the hydrogen combustion engine; wherein a piston of the hydrogen combustion engine is configured to compress and expand the hydrogen injected into the combustion chamber; injecting, by a nozzle, a hydrogen carrier medium into the crankcase for hydrogenation of the carrier medium inside the crankcase with hydrogen leaked from the combustion chamber past a side wall of the piston into the crankcase; collecting, by a collector, the hydrogenated carrier medium from the crankcase; heating, by a heater, the hydrogenated carrier medium for dehydrogenation of the carrier medium and extracting hydrogen from the hydrogenated carrier medium; and injecting, by the nozzle, the dehydrogenated carrier medium into the crankcase for hydrogenation. The present disclosure further provides a system for a motor vehicle, and a motor vehicle comprising the inventive system.

23 Claims, 6 Drawing Sheets

(58) Field of Classification Search
CPC .... F02B 43/10; F02B 43/00; F02B 2043/106; B01D 2256/16; F01P 3/00; F01P 3/10; F01P 3/08; F01P 11/02; F01P 11/0295; F01P 11/028; F01P 11/0285
USPC ..... 123/41.86, 572, 573, 196 R; 55/385.3
See application file for complete search history.

(56) References Cited

FOREIGN PATENT DOCUMENTS

| | | | | |
|---|---|---|---|---|
| CN | 115539199 | A | * | 12/2022 |
| DE | 102019004905 | A1 | | 8/2022 |

* cited by examiner

METHOD FOR ABSORBING HYDROGEN IN A CRANKCASE OF A HYDROGEN INTERNAL COMBUSTION ENGINE, A SYSTEM FOR A MOTOR VEHICLE, AND A MOTOR VEHICLE

TECHNICAL FIELD

The present disclosure pertains to a method for absorbing hydrogen in a crankcase of a hydrogen internal combustion engine, a system for a motor vehicle, and a motor vehicle comprising the inventive system.

BACKGROUND

In hydrogen internal combustion engines (ICE), part of the hydrogen-air mixture passes the piston rings and enters the crankcase during the compression and expansion stroke. Such blow-by gas contains hydrogen (H2) and oxygen (O2). The concentration of hydrogen and oxygen can easily reach a critical level that leads to a sudden exothermic reaction, i.e. an explosion, between the hydrogen and oxygen, which frees up a lot of energy and potentially damages the engine. U.S. Pat. No. 10,309,290 B2 describes a cooling cavity inside a piston of an internal combustion engine. Two cooling jets are configured to inject oil for cooling onto the backside of the piston and into the cooling cavity.

SUMMARY

The present disclosure provides for reducing the hydrogen content in the crankcase in order to prevent the above-mentioned reaction.

To this end, the present disclosure provides a method in accordance with claim 1, a system in accordance with claim 15, and a motor vehicle in accordance with claim 23.

According to one aspect of the disclosure, a method for absorbing hydrogen in a crankcase of a hydrogen internal combustion engine is provided. The method comprises injecting, by a hydrogen injector, hydrogen into a combustion chamber of the hydrogen combustion engine. A piston of the hydrogen combustion engine is configured to compress and expand the hydrogen injected into the combustion chamber, and the method further comprises injecting, by a nozzle, a hydrogen carrier medium into the crankcase for hydrogenation of the carrier medium inside the crankcase with hydrogen leaked from the combustion chamber past a side wall of the piston into the crankcase, collecting, by a collector, the hydrogenated carrier medium from the crankcase, heating, by a heater, the hydrogenated carrier medium for dehydrogenation of the carrier medium and extracting hydrogen from the hydrogenated carrier medium, and injecting, by the nozzle, the dehydrogenated carrier medium into the crankcase for hydrogenation.

According to another aspect of the disclosure, a system for a motor vehicle is provided. The system comprises a hydrogen combustion engine including a combustion chamber, a hydrogen injector for injecting hydrogen into the combustion chamber, a piston for compressing and expanding the hydrogen injected into the combustion chamber, a crankcase located on a lower side of the piston opposite to the combustion chamber, and a nozzle for injecting a hydrogen carrier medium into the crankcase for hydrogenation of the carrier medium inside the crankcase with hydrogen leaked from the combustion chamber past the side walls of the piston into the crankcase. The system further comprises a collector for collecting the hydrogenated carrier medium from the crankcase, and a heater connected to the collector and configured to heat the carrier medium to obtain dehydrogenated carrier medium, wherein the nozzle is configured to inject the dehydrogenated carrier medium into the crankcase.

According to another aspect of the disclosure, a motor vehicle is provided comprising the inventive system for a motor vehicle.

One idea of the present disclosure is to add a hydrogen carrier medium, which is in particular a liquid organic hydrogen carrier (LOHC), to the oil. The carrier medium can be added by injection, preferably spraying, through a nozzle into the crankcase. The nozzle may preferably be configured as any suitable form of injector able to inject or spray the carrier medium into the crankcase. The carrier medium then absorbs the hydrogen of the blow-by gas by an exothermic reaction. In the case of LOHC, the product of this hydrogenation reaction is hydrogen saturated LOHC, i.e. [LOHC+H2].

LOHCs are organic liquids, which are able to absorb and release hydrogen through chemical reactions. Therefore, LOHC can be used for storage and transportation of hydrogen in a safe and secure way. The absorption of hydrogen, or hydrogenation, is an exothermic reaction, whereas the dehydrogenation needs an input of energy and thus is an endothermic reaction. Typical LOHCs are Toluence/Methylcyclohexane (C7H8/C7H14), Dibenzyltoluence (C21H20) or Benzyltoluence (C14H14). Depending on the fluid up to 56 kg hydrogen can be carried in 1 $m^3$ LOHC.

The carrier medium is then collected by a collector inside or near the crankcase and guided to a heater, where the endothermic dehydrogenation reaction takes place to extract unsaturated LOHC and hydrogen from the saturated LOHC. The unsaturated LOHC can then be reused for absorbing further hydrogen in the crankcase. Thus, hydrogen stored in the LOHC can be released in this endothermic reaction and put back to the combustion process continuously or in certain intervals. The extracted hydrogen cannot return into the crankcase.

By repeating the described method or process continuously or in appropriate intervals, the concentration of hydrogen in the crankcase can be kept low, e.g. below 4% (vol.), also during operation of the engine. In the resulting chemical composition present in the crankcase, an exothermic reaction (explosion) of the hydrogen with oxygen is thus no longer possible.

It is understood that the term "vehicle" or "vehicular" or other similar term as used herein is inclusive of motor vehicles in general such as passenger automobiles including sports utility vehicles (SUV), buses, trucks, various commercial vehicles, and the like, and includes vehicles combusting hydrogen. It is further understood that the present disclosure may also be applied to facilities comprising stationary motors and hydrogen combustion engines.

Advantageous embodiments and improvements of the present disclosure are found in the dependent claims.

According to an embodiment of the disclosure, the hydrogen carrier medium is injected, preferably sprayed, into the crankcase in a mixture with a lubricant. In this way, the carrier medium can be injected together with lubricant oil through the same nozzle. No further considerations about the suitability of the carrier medium as a lubricant are necessary. This embodiment thus represents a simple and cost-effective way to inject the carrier medium into the crankcase.

According to an embodiment of the disclosure, the hydrogen carrier medium is configured as a lubricant and injected into the crankcase without an additional lubricant. In this case, the carrier medium substitutes the lubricant oil. In this way, only one liquid can be used for dehydrogenation and lubrication, which simplifies the system.

According to an embodiment of the disclosure, the nozzle is configured as a piston cooling nozzle. The nozzle may also be configured as a piston cooling injector. The injector or nozzle is arranged on a lower side of the piston opposite to the combustion chamber. Typically, such a piston cooling nozzle or injector blows a jet of lubricant towards the lower side of the piston in a direction parallel to the moving of the piston, which moves the piston for compressing and expanding the air fuel mix in the combustion chamber. By using the same type of injector, no additional injector is needed for the carrier medium.

According to an embodiment of the disclosure, hydrogenating the carrier medium includes using a catalyst. The presence of the catalyst strongly facilitates starting the exothermic reaction for hydrogenation. In this way, the carrier medium can be re-used almost endlessly. Furthermore, the heat created by the exothermic reaction can support a vehicle during heat-up. The heat can then be removed by an engine cooling system or engine cooling circuit, which is regularly present in a motor vehicle.

According to an embodiment of the disclosure, the catalyst may comprise or be at least one of nickel, palladium, and platinum. In this way, a well-known and efficient reaction can be induced.

According to an embodiment of the disclosure, the catalyst is formed as a coating on a backside or lower side of a piston and/or on a cylinder liner of a cylinder of the hydrogen combustion engine. The piston is located in the cylinder. A hydrogen combustion engine may have a plurality of such cylinders, e.g. 3, 4, 6, 8 and so on. The backside or lower side of the piston is the side facing the crankcase, thus opposite to a forward or upper side of the piston facing the combustion chamber. The lower side of the piston and the cylinder liner on a cylinder wall represent suitable places for the catalyst to support the reaction for hydrogenation.

According to an embodiment of the disclosure, the coating is formed as a foam. In this way, the surface of the coating is enlarged to allow more catalytic material to be present to support the reaction for hydrogenation. Besides the foam, further surface structures, such as ribs, or simply a rough profile with grooves and bumps, are contemplated.

According to an embodiment of the disclosure, the collector comprises an oil pan. The oil pan is preferably located on a lower side of the crankcase opposite to the combustion chamber. In this way, a simple collector is provided. A pump is configured to suck the hydrogenated carrier medium from the oil pan to the heater. Furthermore, the oil pan may also be collecting dehydrogenated carrier medium, which has been returned from the heater to the oil pan. In this case, the oil pan comprises a mixture of hydrogenated and dehydrogenated carrier medium. An additional oil pump may be configured to suck or pump hydrogenated carrier medium from the oil pan to the nozzle. Preferably, this oil pump sucks the carrier medium from a place in the oil pan, where predominantly dehydrogenated carrier medium accumulates.

According to an embodiment of the disclosure, the heater is configured as a heat exchanger. The heater is thus configured to exchange heat from another heated medium to the carrier medium. The method further comprises feeding an exhaust gas to the heat exchanger for heating the hydrogenated carrier medium. In this way, heat generated by the combustion engine can be reused for heating the carrier medium for dehydrogenation.

According to an embodiment of the disclosure, the exhaust gas is fed from a turbocharger connected to the hydrogen combustion engine and to the heat exchanger. This provides a very efficient way to provide heat from the hydrogen combustion engine to the heat exchanger. A three-way catalyst may be connected between the turbocharger and the heat exchanger for cleaning the exhaust gas.

According to an embodiment of the disclosure, the method further comprises cooling, by a cooler, the carrier medium after dehydrogenation of the carrier medium. In this way, the dehydrogenated carrier medium can be quickly reused, thus improving the efficiency of the process.

According to an embodiment of the disclosure, the cooler is configured as a heat exchanger and connected to an engine cooling circuit configured to cool the hydrogen combustion engine. Therefore, no additional cooling circuit is required for carrying the heat of the carrier medium away from the cooler. In this way, the cooler is well integrated into the architecture of the motor or motor vehicle.

According to an embodiment of the disclosure, the method further comprises injecting, by the hydrogen injector, the hydrogen extracted from the carrier medium into the combustion chamber of the hydrogen combustion engine. The injection of the extracted hydrogen may also be a manifold injection. In this way, the extracted hydrogen can be reused for the combustion process in the combustion chamber, thus leading to a more efficient hydrogen combustion engine.

According to an embodiment of the disclosure, the method further comprises sensing, by a sensor, a concentration of hydrogen in the crankcase. The sensor can be any kind of sensor, such as an electrochemical gas detector, an infrared point sensor, a photoionization detector, or other common types of gas sensors, which are suitable for this task. According to this embodiment, the method further comprises controlling, by a control device, the amount of carrier medium injected into the crankcase based on the sensed concentration of hydrogen in the crankcase. For this, the control device may directly control the nozzle, or a valve, which is configured to regulate the amount of carrier medium to be injected by the nozzle into the crankcase.

According to an embodiment of the disclosure, the system further comprises a pump connected to the collector and the heater. The pump is configured to pump the carrier medium from the collector to the heater. In this way, the transportation of the carrier medium from the collector to the heater is facilitated.

According to an embodiment of the disclosure, the system further comprises a cooler connected to the heater. The cooler is configured to cool the dehydrogenated carrier medium before returning the cooled and dehydrogenated carrier medium back into the crankcase. As mentioned above, in this way, the dehydrogenated carrier medium can be quickly reused, thus improving the efficiency of the process.

According to an embodiment of the disclosure, the cooler is connected to an engine cooling circuit configured to cool the hydrogen combustion engine. As mentioned above, no additional cooling circuit is required for carrying the heat of the carrier medium away from the cooler. In this way, the cooler thus is well integrated into the architecture of the motor vehicle.

According to an embodiment of the disclosure, the system further comprises a turbocharger connected to the hydrogen combustion chamber and the heater such that the heater is heated by an exhaust gas of the turbocharger. This provides a very efficient way to provide heat from the hydrogen combustion engine to the heat exchanger. A three-way catalyst may be connected between the turbocharger and the heat exchanger for cleaning the exhaust gas. Alternatively, the three-way catalyst may be connected directly to the motor in case no turbocharger is present in the vehicle.

According to an embodiment of the disclosure, the system further comprises a sensor arranged and configured to sense a hydrogen concentration in the crankcase. Alternatively, or in addition, the sensor may be configured to sense a saturation level of the carrier medium. As mentioned above, the sensor can be any kind of sensor, which is suitable for this task. The system further comprises a control device configured to control an amount of the carrier medium injected into the crankcase based on the sensed hydrogen concentration in the crankcase and/or based on the saturation level of the carrier medium or LOHC in the crankcase. The control device may directly control the nozzle, or a regulator or valve, which are configured to regulate the amount of carrier medium to be injected by the nozzle into the crankcase. Alternatively, or in addition, the control device may be configured to trigger dehydrogenation of the carrier medium in response to the measured saturation level of the carrier medium.

According to an embodiment of the disclosure, the system further comprises a hydrogen tank connected to the heater and the hydrogen injector. The tank is configured for intermediate storage of the extracted hydrogen. The tank is thus formed suitable for hydrogen storage. In this way, the extracted hydrogen can be stored before it is reused in the hydrogen combustion engine. Therefore, the dehydrogenation reaction can also be efficiently conducted during a stop of the motor vehicle.

The above embodiments and further developments can be combined with each other as desired, if useful. In particular, all features of the method for absorbing hydrogen in a crankcase of a hydrogen internal combustion engine are transferable to the system for a motor vehicle and/or the motor vehicle, and vice versa. Further possible embodiments, further developments and implementations of the disclosure also comprise combinations, not explicitly mentioned, of features of the disclosure described before or below with respect to the embodiments. In particular, the skilled person will thereby also add individual aspects as improvements or additions to the respective basic form of the present disclosure.

The disclosure will be explained in greater detail with reference to exemplary embodiments depicted in the drawings as appended.

BRIEF DESCRIPTION OF THE DRAWINGS

The accompanying drawings are included to provide a further understanding of the present disclosure and are incorporated in and constitute a part of this specification. The drawings illustrate the embodiments of the present disclosure and together with the description serve to explain the principles of the disclosure. Other embodiments of the present disclosure and many of the intended advantages of the present disclosure will be readily appreciated as they become better understood by reference to the following detailed description. The elements of the drawings are not necessarily to scale relative to each other. In the figures, like reference numerals denote like or functionally like components, unless indicated otherwise.

Although specific embodiments are illustrated and described herein, it will be appreciated by those of ordinary skill in the art that a variety of alternate and/or equivalent implementations may be substituted for the specific embodiments shown and described without departing from the scope of the present disclosure. Generally, this application is intended to cover any adaptations or variations of the specific embodiments discussed herein.

DETAILED DESCRIPTION

Figure 1:
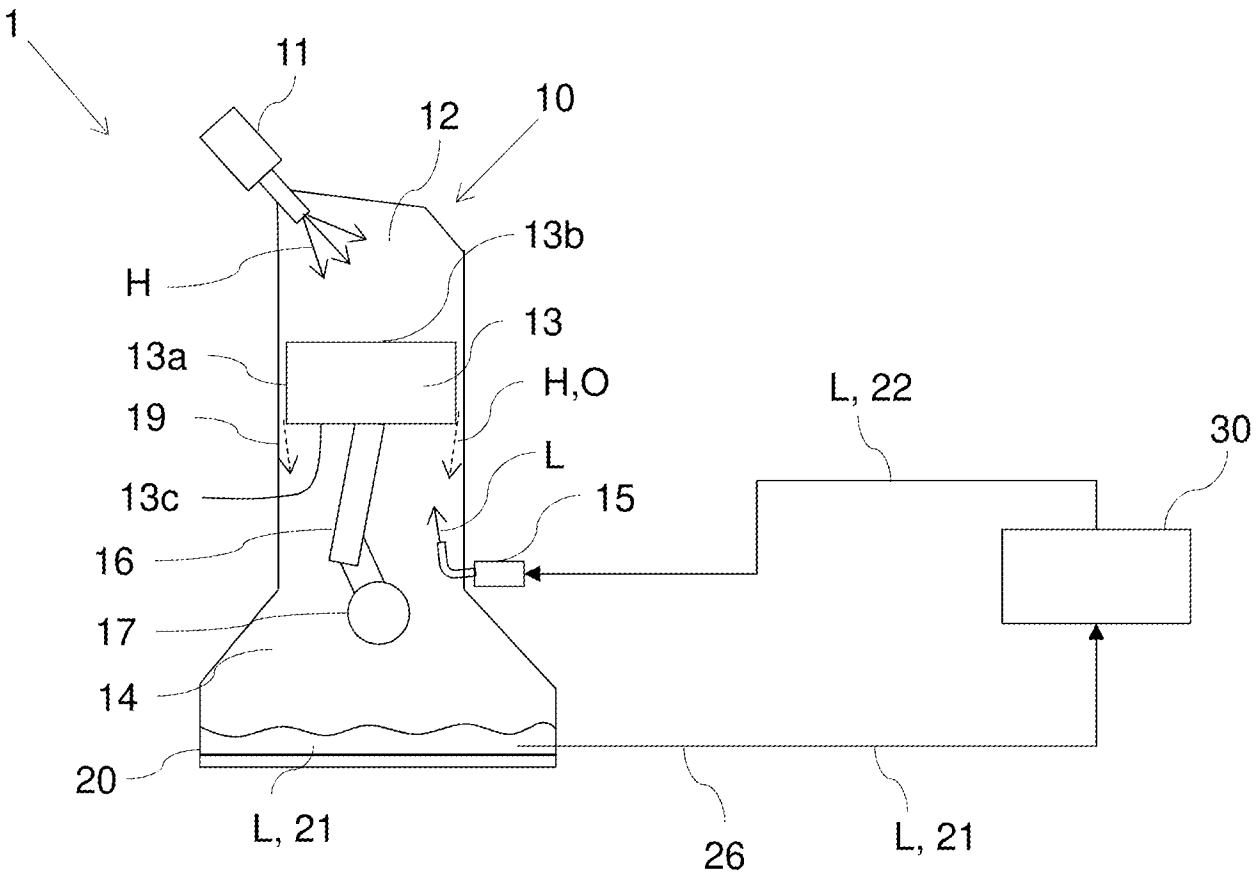
FIG. 1 depicts a system for a motor vehicle according to an embodiment of the disclosure.

FIG. 1 schematically depicts a system 1 for a motor vehicle 100 according to an embodiment of the disclosure.

The system 1 for a motor vehicle 100 comprises a hydrogen combustion engine 10. The motor vehicle 100 (not shown in FIG. 1) can be any kind of vehicle, such as passenger automobiles including sports utility vehicles (SUV), buses, trucks, various commercial vehicles, and the like, and includes vehicles combusting hydrogen. Besides automobiles, the system 1 may also be applied to larger vehicles such as trucks, busses, and the like. However, the system 1 can also be applied to further vehicles and even installations having a hydrogen combustion engine 10, such as a ship, a train, an airplane or a power plant.

The combustion engine 10 comprises a combustion chamber 12 and a hydrogen injector 11. Besides hydrogen direct injection, the hydrogen injector 11 may also support manifold injection, thus injecting hydrogen H together with other components. The hydrogen injector 11 is arranged on an upper part of the hydrogen combustion engine 10 and configured to inject hydrogen H into the combustion chamber 12. The hydrogen injector 11 thus receives hydrogen H as fuel over a connected fuel line from a hydrogen storage tank (both not shown in FIG. 1). Besides hydrogen, oxygen is led into the combustion chamber 10 for driving the hydrogen combustion engine 10.

The hydrogen combustion engine 10 further comprises a piston 13 for compressing and expanding the hydrogen H and air or air-fuel mix injected into the combustion chamber 12 together with remaining exhaust gas. Compressing and expanding of the combustion chamber 12 is achieved here by connecting the piston 13 to a piston rod 16, which is connected to a rotatable crankshaft 17.

The hydrogen combustion engine 10 further comprises a crankcase 14 located on a lower side 13*a* of the piston 13 opposite to the combustion chamber 12, and a nozzle 15 for injecting a hydrogen carrier medium L into the crankcase 14 for hydrogenation of the carrier medium L inside the crankcase 14 with hydrogen leaked H from the combustion chamber 12 past the side walls 13*a* of the piston 13 into the crankcase 14. In some embodiments, the nozzle 15 is configured as an injector able to inject or spray the carrier medium L into the crankcase 14.

The leakage of hydrogen H from the combustion chamber 12 past the piston 13 into the crankcase 14 is indicated in FIG. 1 by the dashed arrows. Besides the hydrogen H, also oxygen O regularly leaks into the crankcase 14, or is present in the crankcase 14, which, in case of a too-high concentration of the hydrogen, leads to an exothermic reaction, i.e. explosion, of the two chemical components. By binding the hydrogen H to the carrier medium L, the concentration of hydrogen H is thus decreased.

The carrier medium L preferably is a liquid organic hydrogen carrier (LOHC). LOHCs are organic liquids, which are able to absorb and release hydrogen through chemical reactions. Therefore, LOHC can be used for storage and transportation of hydrogen in a safe and secure way. The absorption of hydrogen, or hydrogenation, is an exothermic reaction, whereas the dehydrogenation needs an input of energy and thus is an endothermic reaction. Typical LOHCs are Toluence/Methylcyclohexane (C7H8/C7H14), Dibenzyltoluence (C21H20) or Benzyltoluence (C14H14). Depending on the fluid up to 56 kg hydrogen can be carried in 1 $m^3$ LOHC.

The injected carrier medium L thus hydrogenates in the crankcase 14 to a hydrogenated carrier medium 21. In the case of LOHC as carrier medium L, the hydrogenation produces [LOHC+H2] as a chemical product. In some embodiments, a pressure of e.g. 30 to 50 bar may be present in the crankcase 14 for the hydrogenation reaction. In further embodiments, the hydrogenation reaction may cause a temperature of e.g. 150° C. to 200° C. in the crankcase 14.

In this embodiment, the hydrogen carrier medium L is injected in the crankcase 14 in a mixture with a lubricant. Furthermore, in this embodiment, the nozzle 15 is configured as a piston cooling nozzle, a piston cooling injector or piston cooling jet. Therefore, beside the effect of lubrication, the injection of the carrier medium L and/or the lubricant has the effect of cooling the piston 13. The nozzle 15 is thus arranged on a lower side 13*c* of the piston 13 opposite to the combustion chamber. The lower side 13 of the piston 13 is thus facing the crankcase 14, whereas a forward or upper side 13*b* of the piston 13 is facing the combustion chamber 12. The injection of the carrier medium L is directed substantially in the parallel to the movement of the piston 13 during compression, i.e. in the vertical upward direction in FIG. 1, towards the piston 13.

In further embodiments, the hydrogen carrier medium L is configured as a lubricant and injected in the crankcase 14 without an additional lubricant. The carrier medium L is then injected by a separate injector or nozzle different from the here used piston cooling nozzle.

The system 1 further comprises a collector 20 for collecting the hydrogenated carrier medium 21 from the crankcase 14. In this embodiment, the collector 20 is arranged on a side of the crankcase 14 opposite to the combustion chamber 12. Preferably the lower side of the crankcase 14 is used to arrange the collector 20 so that the hydrogenated carrier medium 21 is thus falling down the crankcase 14 by the force of the gravitation.

A heater 30 is connected to the collector 20 and configured to heat the carrier medium 21 for dehydrogenation. In this embodiment, a pipe 26 is partly penetrating the hydrogenated carrier medium 21 in the collector 20. The pipe 26 is configured such that the hydrogenated carrier medium 21 flows to the heater 30. The heater 30 heats the carrier medium 21 in order to start the endothermic reaction for dehydrogenation. In this way, dehydrogenated carrier medium 22 is produced and hydrogen H is freed. In case of LOHC as chemical product, the dehydrogenation reaction starts with [LOHC+H2] to produce LOHC+H2. In some embodiments, for this endothermic reaction, the heater is configured to provide temperatures of about 250° C. to 300° C.

The nozzle 15 is configured to inject the dehydrogenated carrier medium 22 into the crankcase 14. This may be realized by a direct connection from the heater 30 to the nozzle 15, such as indicated in FIG. 1. In further embodiments, the dehydrogenated carrier medium 22 may be returned to the collector 20 from where an oil pump pumps the dehydrogenated carrier medium 22 to the nozzle 15. In either way, the carrier medium L can be reused over many cycles.

Figure 2:
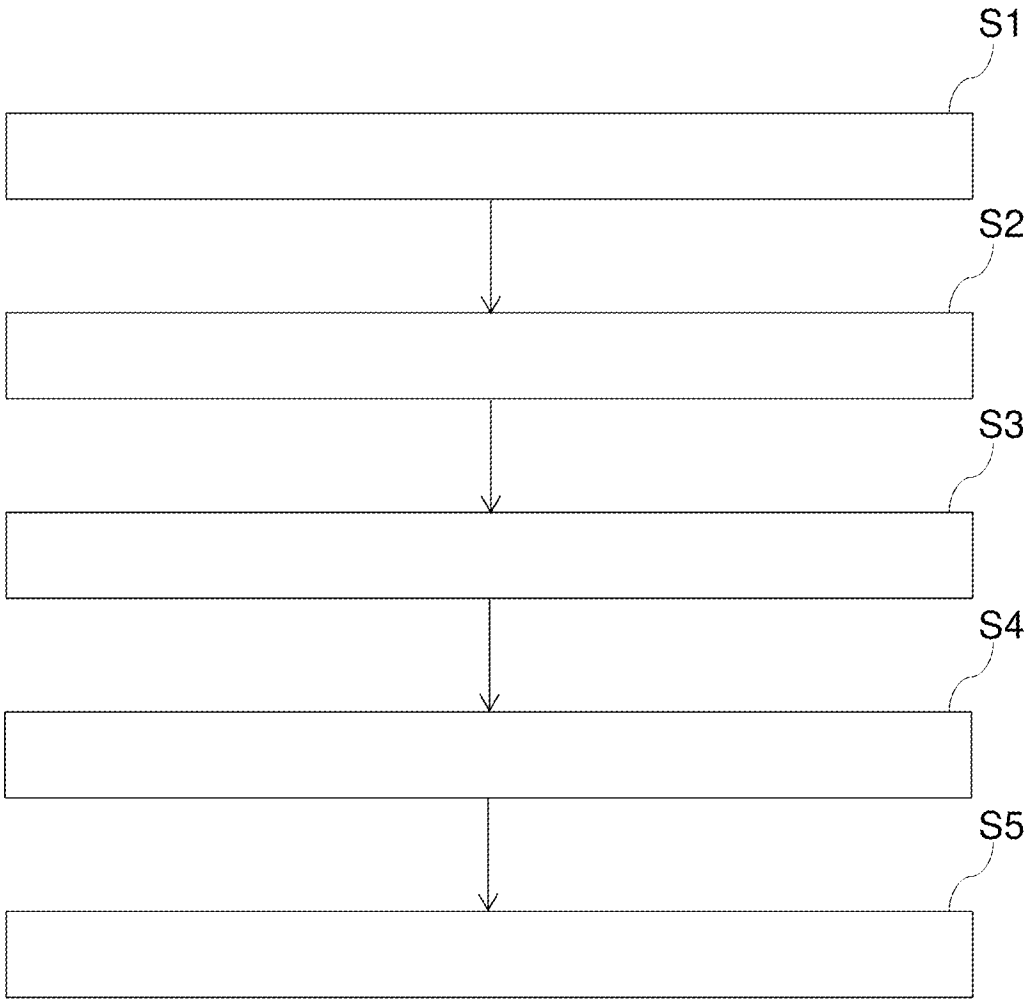
FIG. 2 shows a flow diagram of a method for absorbing hydrogen in a crankcase of a hydrogen internal combustion engine according to an embodiment of the disclosure.

FIG. 2 schematically shows a flow diagram of a method for absorbing hydrogen H in a crankcase 14 of a hydrogen internal combustion engine 10 according to an embodiment of the disclosure. The method shown in FIG. 2 corresponds to the system 1 described above with reference to FIG. 1. The method comprises the step of injecting S1, by a hydrogen injector 11, hydrogen H into a combustion chamber 12 of the hydrogen combustion engine 10. The hydrogen combustion engine 10 is typically installed in a vehicle, such as an automobile, a truck, a bus, etc. However, the method can also be applied to other vehicles or installations having a hydrogen combustion engine 10, such as a ship, a train, an airplane or a power plant.

In the present case, the combustion engine 10 comprises a piston 13, which is configured to compress and expand the hydrogen H injected into the combustion chamber 12.

The method further comprises the step of injecting S2, preferably spraying, by a nozzle 15, which may be configured as an injector, a hydrogen carrier medium L into the crankcase 14 for hydrogenation of the carrier medium L inside the crankcase 14 with hydrogen H leaked from the combustion chamber 12 past a side wall 13*a* of the piston 13 into the crankcase 14.

The method comprises the additional step of collecting S3, by a collector 20, the hydrogenated carrier medium 21 from the crankcase 14.

A further step of the method includes heating S4, by a heater 30, the hydrogenated carrier medium 21 for dehydrogenation of the carrier medium L, 21 and extracting hydrogen H from the hydrogenated carrier medium L, 21.

An additional step injecting S5, preferably spraying, by the nozzle 15, the dehydrogenated carrier medium L, 22 into the crankcase 14 for hydrogenation is provided by the shown method.

It is understood that the method or process as described above can continue continuously or in appropriate intervals by repeating the steps of collecting S3 the hydrogenated carrier medium 21, heating S4 the hydrogenated medium 21 for dehydrogenation, and further injected the dehydrogenated carrier medium 22 by the nozzle 15 into the crankcase 14. In this way, the hydrogen concentration in the crankcase 14 can be kept low, thus avoiding an exothermic reaction between the oxygen O and hydrogen H in the crankcase 14.

Figure 3:
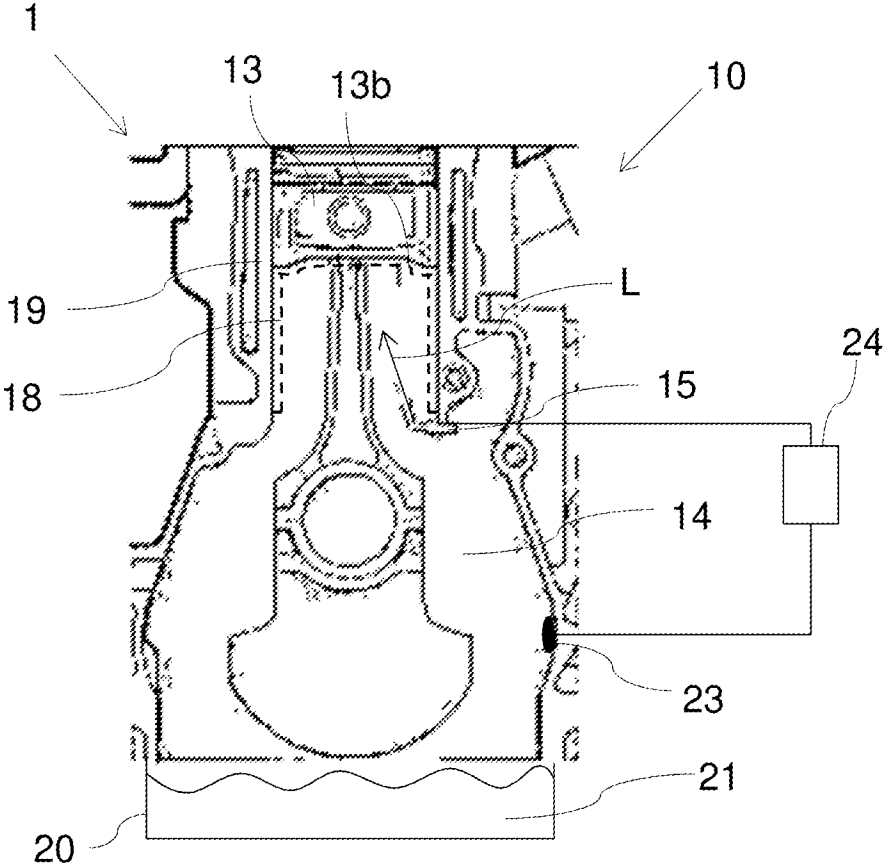
FIG. 3 depicts a crankcase and a collector of a system according to a further embodiment of the disclosure.

FIG. 3 schematically depicts a crankcase 14 and a collector 20 of a system 1 according to a further embodiment of the disclosure.

The crankcase 14 including the piston 13 and the collector shown in FIG. 3 is based on the corresponding components of the system 1 shown and described with reference to FIG.

1. In this embodiment, however, a catalyst 18 is provided on a lower side 13*c* of a piston 13 and on a cylinder liner 19*a* of a cylinder 19 of the hydrogen combustion engine 10. The piston 13 is located and configured to move in the cylinder 19, as it is known in usual internal combustion engines 10.

The catalyst 18 in this embodiment is formed as a coating. In some embodiments, the catalyst comprises nickel, palladium and/or platinum alone or in combination. The process of hydrogenating the carrier medium L includes using the catalyst 18, in particular, for starting the exothermic reaction. Furthermore, the heat created by the exothermic reaction can support a vehicle during heat-up. The heat can then be removed by an engine cooling system or engine cooling circuit, which is regularly present in a motor vehicle.

The system 1 further comprises a sensor 23 arranged and configured to sense a hydrogen concentration in the crankcase 14. The sensor 23 is configured as a gas sensor and placed at a side wall of the crankcase 14 below the nozzle 15. In this embodiment, the sensor 23 is configured as an electrochemical gas detector. In further embodiments, the gas sensor is configured as an infrared point sensor or a photoionization detector. Other common types of gas sensors, which are suitable for this task, can be applied.

A control device 24 is connected to the sensor 23 and configured to control an amount of the carrier medium L injected into the crankcase 14 based on the sensed hydrogen concentration in the crankcase 14. The control device 24 is configured to control the injection of the carrier medium L into the crankcase 14 according to a need for the carrier medium. In further embodiments, the sensor 23 may be configured to sense a saturation level of the carrier medium. In particular, if the concentration becomes high, which is about 4% per volume, the control device 24 transmits a signal to the nozzle 15 or, in further embodiments, to a valve able to regulate the output of the nozzle 15 to inject the carrier medium L into the crankcase 14. The control device 24 can also be configured to regulate the amount of carrier medium L used or mixed together with a lubricant according to the actual need. The sensor 23 is thus sensing a concentration of hydrogen H in the crankcase 14 and the control device 24 is controlling the amount of carrier medium L injected into the crankcase 14 based on the sensed concentration of hydrogen H in the crankcase 14. In this way, the carrier medium L can be injected continuously or in appropriate injection intervals into the crankcase 14 to keep the hydrogen concentration below a certain threshold, e.g. below 4%.

In various embodiments, in which the sensor 23 is configured the saturation level of the carrier medium L, the control device 24 may be configured to trigger dehydrogenation of the carrier medium L in response to the measured saturation level of the carrier medium L.

Figure 4A:
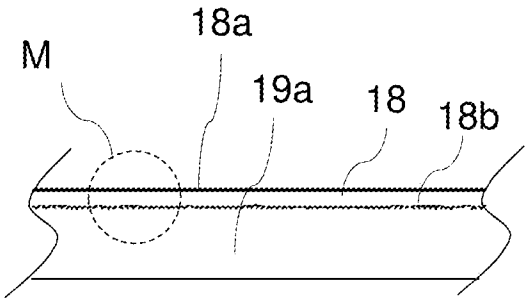
FIG. 4*a* shows a catalyst coating of a surface of the system according to a further embodiment of the disclosure.
Figure 4B:
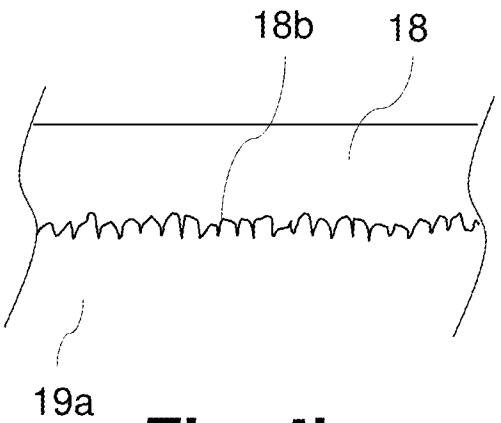
FIG. 4*b* schematically shows a catalyst coating of a surface of the system according to a further embodiment of the disclosure.

FIGS. 4*a* and 4*b* schematically show a catalyst coating of a surface of the system 1 according to a further embodiment of the disclosure.

In the embodiment shown in FIG. 4*a*, the catalyst 18 is formed as a coating, which can be located on a lower side 13*c* of a piston 13 and/or on a cylinder liner 19*a* of a cylinder 19 of the hydrogen combustion engine 10, as described above.

This can be seen in FIG. 4*b*, which is a magnified image of the section M as indicated in FIG. 4*a*. A profile of the coating has a roughness at the inner surface 18*b* facing a substrate 19*a*, which is in this case a cylinder liner 19*a*. In further embodiments, a separate substrate 19*a* may be applied onto the surface of the cylinder 19 facing the piston 13 and onto the lower side 13*c* of the piston 13, before applying the catalyst 18 as a coating. In further embodiments, the substrate 19*a* is formed as a coating on the piston 13.

The profile of the inner surface 18*b* of the catalyst 18 contains trenches and bumps or elevations, which enlarges the surface area for facilitating the reaction of the carrier medium L and the hydrogen H. In further embodiments, the coating of the catalyst 18 is formed as a foam. In some embodiments, the foam is applied to the lower side 13*c* of the piston 13. A foam further increases the inner and outer surfaces 18*a*, 18*b* of the catalyst 18 available for the reaction with the carrier medium L and the hydrogen H.

Figure 5:
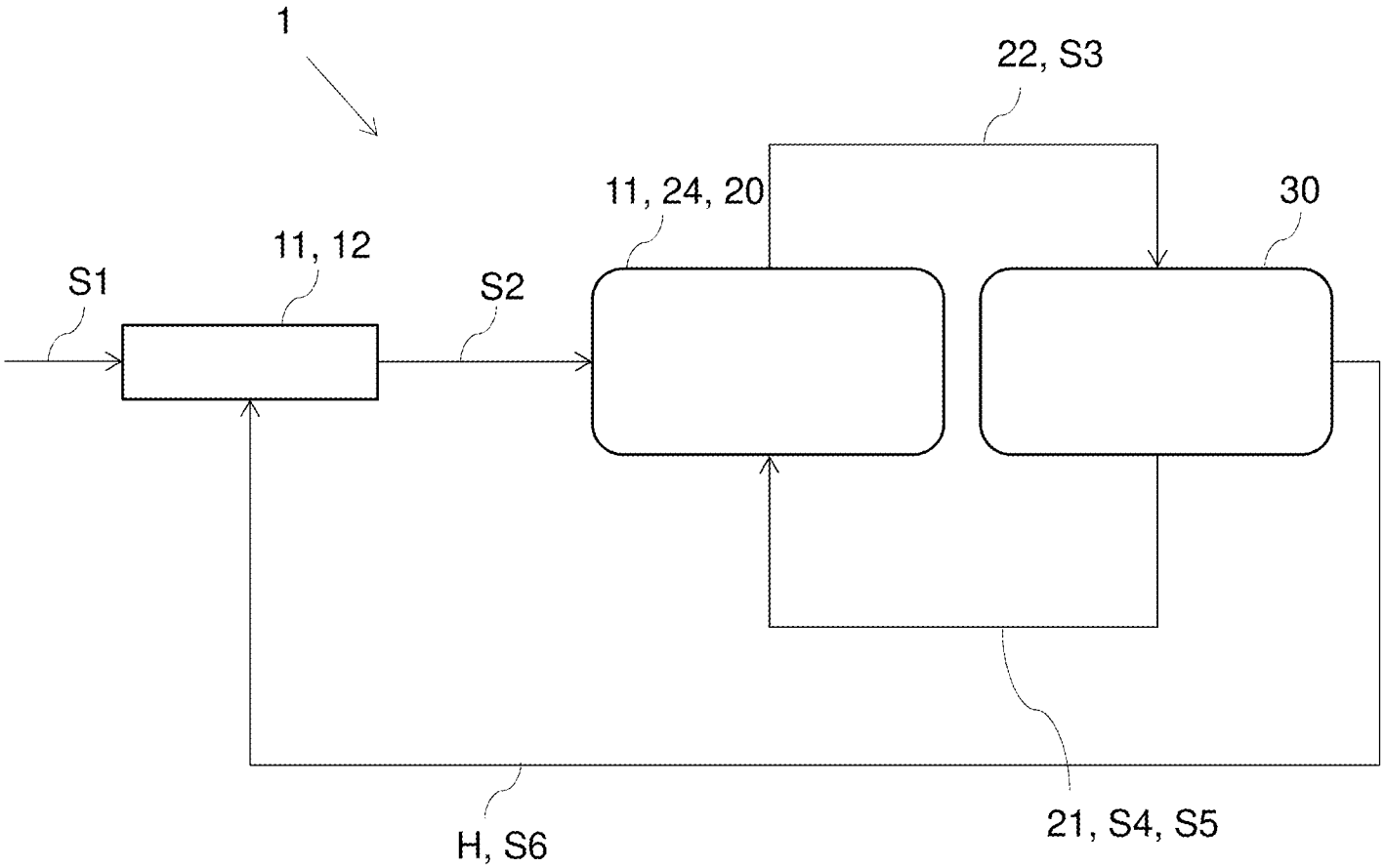
FIG. 5 shows a flow diagram of a method for absorbing hydrogen in a crankcase of a hydrogen internal combustion engine according to a further embodiment of the disclosure.

FIG. 5 schematically shows a flow diagram of a method for absorbing hydrogen H in a crankcase 14 of a hydrogen combustion engine 10 according to a further embodiment of the disclosure.

A flow diagram is shown in FIG. 5, indicating a process between components of a system 1 for a motor vehicle. The system 1 shown in FIG. 5 is based on the system 1 described above with reference to FIG. 1.

In this figure, the step of injecting the hydrogen H by the hydrogen injector 11 into the combustion chamber 12 is indicated by the arrow S1 directed to element 12. This further applies to the remaining steps S2 and S3 to S5, which are shown here as repeating steps involving the nozzle 15 and collector 20, and the heater 30.

In addition to step S1 to S5, the method further comprising the step of injecting S6, by the hydrogen injector 11, the hydrogen H extracted from the carrier medium L into the combustion chamber 12 of the hydrogen combustion engine 10. The system 1 described here thus reuses the hydrogen for driving or running the hydrogen combustion engine 10. In further embodiments, the extracted hydrogen H is simply discharged to the outside of the vehicle.

Figure 6:
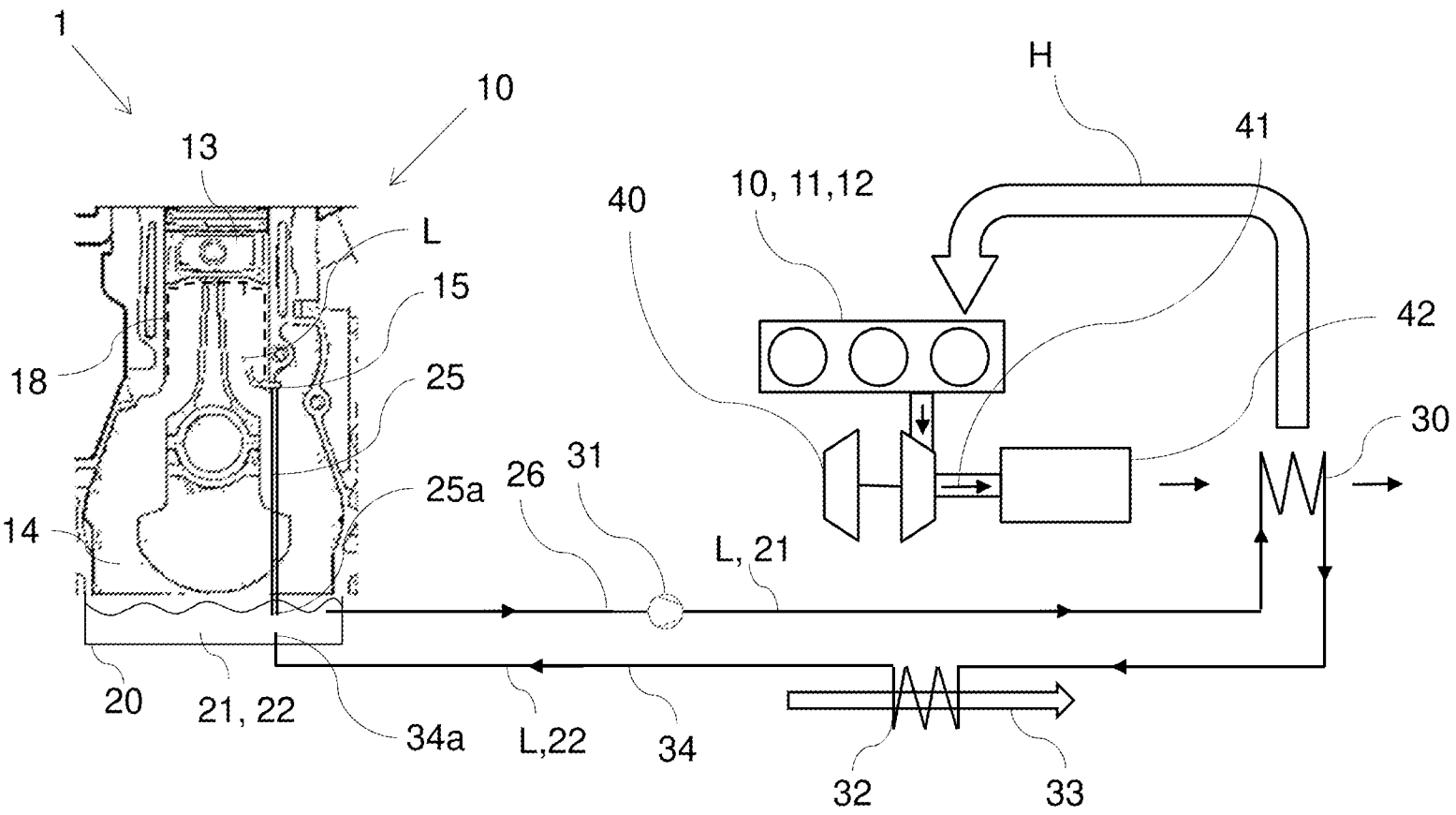
FIG. 6 shows a system for a motor vehicle according to an embodiment of the disclosure.

FIG. 6 schematically shows a system 1 for a motor vehicle 100 according to an embodiment of the disclosure.

The system 1 shown in FIG. 6 is based on the system 1 shown and described above with reference to FIG. 1, as well as it is combinable with the components shown and described above with reference in FIG. 3. It is also suitable to conduct the method described so far.

In addition to the system 1 described so far, the system 1 of the present embodiment further comprises a pump 31 connected to the collector 20 and the heater 30 and configured to pump the carrier medium L from the collector 20 to the heater 30. The cooler 32 is thus located on the connection of pipe 34, which connects the collector 20 with the heater 30. In this embodiment, the collector 20 comprises or is configured as an oil pan. The pump 31 is configured to suck the hydrogenated carrier medium 21 and pump the hydrogenated carrier medium 21 from the oil pan to the heater 30. The pump 31 thus transports the hydrogenated carrier medium 21 to the heater.

The system 1 further comprises a turbocharger 40 connected to the hydrogen combustion chamber 12 and the heater 30 such that the heater 30 is heated by an exhaust gas 41 of the turbocharger 40. The heater 30 is thus configured as a heat exchanger and the heat from the exhaust gas 41 feeds the heat exchanger 30 for heating the hydrogenated carrier medium 21. In this embodiment, the exhaust gas 41 exits the turbocharger 40 and enters an optional three-way catalyst 42, where unburned components of the exhaust gas react. The so cleaned exhaust gas 42 then enters the heat exchanger 30 to heat the hydrogenated carrier medium 21 for dehydrogenation and produce dehydrogenated carrier medium 22.

In the embodiment of FIG. 6, the system 1 shown in FIG. 6 further comprises a cooler 32 connected to the heater 30. The cooler 32 is configured to cool the dehydrogenated carrier medium 22 before the dehydrogenated carrier medium 22 is injected back into the crankcase 14 by the nozzle 15. In this embodiment, the cooler 32 is connected to the collector 20 by a connection 34. The collector 20, i.e. the oil pan thus contains a mixture of hydrogenated carrier medium 21 and dehydrogenated carrier medium 22. An oil pump (not shown in FIG. 6) is then pumping the carrier medium 21, 22 from the oil pump to the nozzle 15 over a connection 25. In this embodiment, an inlet 25*a* of the connection 25 is located near an outlet 34*a* of the connection 34 delivering the dehydrogenated carrier medium 22 to the oil pan, as it is indicated schematically in FIG. 6. The connection 25 may be formed by a pipe. In this way, a large fraction of dehydrogenated carrier medium 22 is guided to the nozzle 15.

In this embodiment, the cooler 32 is configured as a heat exchanger and connected to an engine cooling circuit 33. The engine cooling circuit 33 is configured to cool the hydrogen combustion engine 10 and is typically present in a motor vehicle 100.

Similar to the method and system 1 described with reference to FIG. 5, the embodiment shown in FIG. 6 the hydrogen H extracted from the carrier medium L is injected S6 into the combustion chamber 12 of the hydrogen combustion engine 10 by the hydrogen injector 11. Elements 10 to 12 are thus summarized in FIG. 6. In this way, the hydrogen H extracted from the hydrogenated carrier medium 21 is reused to drive the hydrogen combustion engine 10. In further embodiments, the extracted hydrogen H is discharged to the outside of the vehicle.

In further embodiments, the system 1 additionally comprises a hydrogen tank connected to the heater 30 and the hydrogen injector 11. Such a tank is configured for intermediate storage of the extracted hydrogen H. The extracted hydrogen can be stored in the tank before its reuse in the hydrogen combustion engine 10. The dehydrogenation thus be conducted during a stop of the vehicle.

Figure 7:
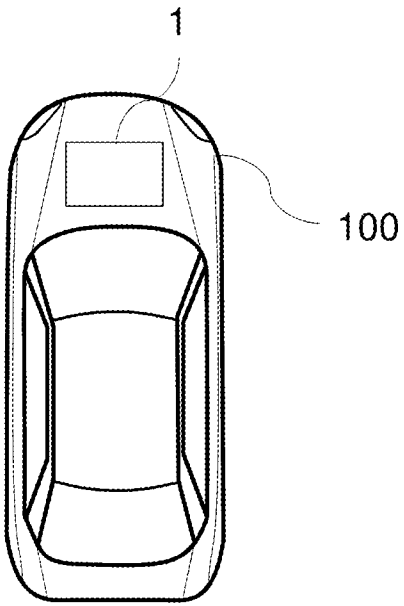
FIG. 7 shows a motor vehicle according to an embodiment of the disclosure.

FIG. 7 schematically shows a motor vehicle according to an embodiment of the disclosure.

The motor vehicle 100 shown in FIG. 7 comprises the system 1 described so far. As described above, although an automobile is shown in FIG. 7, in further embodiments, the system 1 is integrated into other types of vehicles, such as a truck, a bus, a ship, a train, an airplane or facilities such as a power plant.

In the foregoing detailed description, various features are grouped together in one or more examples or examples with the purpose of streamlining the disclosure. It is to be understood that the above description is intended to be illustrative, and not restrictive. It is intended to cover all alternatives, modifications and equivalents of the different features and embodiments. Many other examples will be apparent to one skilled in the art upon reviewing the above specification. The embodiments were chosen and described in order to explain the principles of the disclosure and its practical applications, to thereby enable others skilled in the art to utilize the disclosure and various embodiments with various modifications as are suited to the particular use contemplated.

The invention claimed is:

1. A method for absorbing hydrogen (H) in a crankcase (14) of a hydrogen internal combustion engine (10), comprising:

injecting (S1), by a hydrogen injector (11), hydrogen (H) into a combustion chamber (12) of the hydrogen combustion engine (10); wherein a piston (13) of the hydrogen combustion engine (10) is configured to compress and expand the hydrogen (H) injected into the combustion chamber (12);

injecting (S2), by a nozzle (15), a hydrogen carrier medium (L) into the crankcase (14) for hydrogenation of the carrier medium (L) inside the crankcase (14) with hydrogen (H) leaked from the combustion chamber (12) past a side wall (13*a*) of the piston (13) into the crankcase (14);

collecting (S3), by a collector (20), the hydrogenated carrier medium (21) from the crankcase (14);

heating (S4), by a heater (30), the hydrogenated carrier medium (21) for dehydrogenation of the carrier medium (L, 21) and extracting hydrogen (H) from the hydrogenated carrier medium (L, 21); and injecting (S5), by the nozzle (15), the dehydrogenated carrier medium (L, 22) into the crankcase (14) for hydrogenation.

2. The method according to claim 1, wherein the hydrogen carrier medium (L) is injected into the crankcase (14) in a mixture with a lubricant.

3. The method according to claim 1, wherein the hydrogen carrier medium (L) is configured as a lubricant and injected into the crankcase (14) without an additional lubricant.

4. The method according to claim 1, wherein the nozzle (15) is configured as a piston cooling nozzle, and wherein the nozzle (15) is arranged on a lower side (13*c*) of the piston (13) opposite to the combustion chamber.

5. The method according to claim 1, wherein hydrogenating the carrier medium (L) includes using a catalyst (18).

6. The method according to claim 5, wherein the catalyst (18) comprises at least one of nickel, palladium, platinum.

7. The method according to claim 5, wherein the catalyst (18) is formed as a coating on a lower side (13*c*) of a piston (13) and/or on a cylinder liner (19*a*) of a cylinder (19) of the hydrogen combustion engine (12).

8. The method according to claim 7, wherein the coating is formed as a foam.

9. The method according to claim 1, wherein the collector (20) comprises an oil pan, wherein a pump (31) is configured to suck the hydrogenated carrier medium (L, 21) from the oil to the heater (30).

10. The method according to claim 1, wherein the heater (30) is configured as a heat exchanger, and further comprising:

feeding an exhaust gas (41) to the heat exchanger (30) for heating the hydrogenated carrier medium (L, 21).

11. The method according to claim 10, wherein the exhaust gas (41) is fed from a turbocharger (40) connected to the hydrogen combustion engine (10) and to the heat exchanger (30).

12. The method according to claim 1, further comprising:

cooling, by a cooler (32), the carrier medium (L, 22) after dehydrogenation.

13. The method according to claim 12, wherein the cooler (32) is configured as a heat exchanger and connected to an engine cooling circuit (33) configured to cool the hydrogen combustion engine (10).

14. The method according to claim 1, further comprising:

injecting (S6), by the hydrogen injector (11), the hydrogen (H) extracted from the carrier medium (L) into the combustion chamber (12) of the hydrogen combustion engine (10).

15. The method according to claim 1, further comprising:

sensing, by a sensor (23), a concentration of hydrogen (H) in the crankcase (14) and/or a saturation level of the carrier medium (L), and controlling, by a control device (24), the amount of carrier medium (L) injected into the crankcase (14) based on the sensed concentration of hydrogen (H) in the crankcase (14) and/or based on the sensed saturation level of the carrier medium (L).

16. A system (1) for a motor vehicle (100), comprising a hydrogen combustion engine (10) including a combustion chamber (12), a hydrogen injector (11) for injecting hydrogen (H) into the combustion chamber (12), a piston (13) for compressing and expanding the hydrogen (H) injected into the combustion chamber (12), a crankcase (14) located on a lower side (13*c*) of the piston (13) opposite to the combustion chamber (12), and a nozzle (15) for injecting a hydrogen carrier medium (L) into the crankcase (14) for hydrogenation of the carrier medium (L) inside the crankcase (14) with hydrogen (H) leaked from the combustion chamber (12) past the side walls (13*a*) of the piston (13) into the crankcase (14);

a collector (20) for collecting the hydrogenated carrier medium (L, 21) from the crankcase (14); and a heater (30) connected to the collector (20) and configured to heat the carrier medium (L, 21) to obtain dehydrogenated carrier medium (L, 22), wherein the nozzle (15) is configured to inject the dehydrogenated carrier medium (L, 22) into the crankcase (14).

17. The system (1) according to claim 16, further comprising a pump (31) connected to the collector (20) and the heater (30) and configured to pump the carrier medium (L, 21) from the collector (20) to the heater (30).

18. The system (1) according to claim 16, further comprising a cooler (32) connected to the heater (30), wherein the cooler (32) is configured to cool the dehydrogenated carrier medium (L, 22) before injecting the cooled and dehydrogenated carrier medium (L, 22) back into the crankcase (14).

19. The system (1) according to claim 18, wherein the cooler (32) is connected to an engine cooling circuit (33) configured to cool the hydrogen combustion engine (10).

20. The system (1) according to claim 16, further comprising a turbocharger (40) connected to the hydrogen combustion chamber (12) and the heater (30) such that the heater (30) is heated by an exhaust gas (41) of the turbocharger (40).

21. The system (1) according to claim 16, further comprising a sensor (23) arranged and configured to sense a hydrogen concentration in the crankcase (14), and a control device (24) configured to control an amount of the carrier medium (L) injected into the crankcase (14) based on the sensed hydrogen concentration and/or the saturation level of the carrier medium (L) in the crankcase (14).

22. The system (1) according to claim 16, further comprising a hydrogen tank connected to the heater (30) and the hydrogen injector (11), wherein the tank is configured for intermediate storage of the extracted hydrogen (H).

23. A motor vehicle (100) comprising the system (1) according to claim 16.

* * * * *